US010487831B2

(12) United States Patent
Ohta et al.

(10) Patent No.: US 10,487,831 B2
(45) Date of Patent: Nov. 26, 2019

(54) SCROLL COMPRESSOR

(71) Applicant: MITSUBISHI HEAVY INDUSTRIES THERMAL SYSTEMS, LTD., Minato-ku, Tokyo (JP)

(72) Inventors: Masahiro Ohta, Tokyo (JP); Makoto Takeuchi, Tokyo (JP); Kazuhide Watanabe, Aichi (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 15/323,632

(22) PCT Filed: Jul. 28, 2015

(86) PCT No.: PCT/JP2015/071299
§ 371 (c)(1),
(2) Date: Jan. 3, 2017

(87) PCT Pub. No.: WO2016/042916
PCT Pub. Date: Mar. 24, 2016

(65) Prior Publication Data

US 2017/0146014 A1 May 25, 2017

(30) Foreign Application Priority Data

Sep. 17, 2014 (JP) ..... 2014-189061

(51) Int. Cl.
*F04C 29/00* (2006.01)
*F04C 18/02* (2006.01)
(Continued)

(52) U.S. Cl.
CPC ..... *F04C 29/0021* (2013.01); *F04C 18/0215* (2013.01); *F04C 18/0261* (2013.01);
(Continued)

(58) Field of Classification Search
CPC .....
F04C 18/0215; F04C 18/026; F04C 18/0253; F04C 27/005; F04C 27/001; F04C 27/008; F04C 27/007; F04C 29/0021
(Continued)

(56) References Cited

U.S. PATENT DOCUMENTS 4,993,928 A * 2/1991 Fraser, Jr. ..... F04C 27/005 418/55.4
5,591,014 A * 1/1997 Wallis ..... F04C 18/0215 417/310
(Continued)

FOREIGN PATENT DOCUMENTS

JP 2-9973 A 1/1990
JP 8-159051 A 6/1996
(Continued)

*Primary Examiner* — Deming Wan
(74) *Attorney, Agent, or Firm* — Birch, Stewart, Kolasch & Birch, LLP.

(57) ABSTRACT

The area of a back-pressure chamber is increased so that pressing force on a rotational scroll due to back pressure is enhanced to reduce leakage of refrigerant gas through a chip clearance, thereby achieving improved compression efficiency.

A scroll compression mechanism configured to form a compression pocket between a fixed scroll and a rotational scroll 10 facing each other and including a thrust plate 12 configured to support a thrust load of the rotational scroll 10, and a back-pressure supplying mechanism 6 configured to supply part of compressed refrigerant gas to a back side of the thrust plate 12 as back pressure are provided. The back-pressure supplying mechanism 6 includes a back-pressure chamber 31 formed on a thrust surface 30 facing the back side of the thrust plate 12, a back-pressure supplying path 32 through which the compressed refrigerant gas is supplied to the back-pressure chamber 31, and an inner seal ring 33 and an outer seal ring 34 disposed radially inside and
(Continued)

outside, respectively, of the back-pressure chamber 31. The outer seal ring 34 is provided to be pressed between an inner peripheral surface 37 of a housing 2*a* and an outer peripheral surface 12*a* of the thrust plate 12.

4 Claims, 5 Drawing Sheets

(51) Int. Cl.
*F04C 27/00* (2006.01)
*B29C 43/36* (2006.01)

(52) U.S. Cl.
CPC ..... *F04C 27/001* (2013.01); *F04C 27/005* (2013.01); *F04C 27/008* (2013.01); *F04C 2240/30* (2013.01); *F04C 2240/60* (2013.01)

(58) Field of Classification Search
USPC ..... 418/55.5, 65, 57, 140, 55.1
See application file for complete search history.

(56) References Cited

U.S. PATENT DOCUMENTS

| | | | | |
|---|---|---|---|---|
| 5,622,488 | A * | 4/1997 | Tojo | F04C 18/0215 418/55.5 |
| 8,029,254 | B2 * | 10/2011 | Sato | F04C 18/0215 418/140 |
| 2003/0000238 | A1 * | 1/2003 | Uchida | F04C 27/005 62/323.4 |
| 2006/0263225 | A1 * | 11/2006 | Ueda | F04C 27/005 418/55.5 |
| 2009/0246057 | A1 * | 10/2009 | Sugimoto | F04C 18/0215 418/55.1 |

FOREIGN PATENT DOCUMENTS

| | | | |
|---|---|---|---|
| JP | 2865904 | B2 | 3/1999 |
| JP | 2923088 | B2 | 7/1999 |
| JP | 2006-322421 | A | 11/2006 |
| JP | 3893487 | B2 | 3/2007 |
| WO | WO 2010/064426 | A1 | 6/2010 |

* cited by examiner

SCROLL COMPRESSOR

TECHNICAL FIELD

The present invention relates to a scroll compressor, and particularly relates to a scroll compressor preferably applied to an on-vehicle air conditioner required to achieve downsizing.

BACKGROUND ART

A scroll compressor used in an on-vehicle air conditioner includes a fixed scroll and a rotational scroll. The fixed scroll and the rotational scroll are each a circular end plate with a spiral wrap integrally formed on one of surfaces thereof. The fixed scroll and the rotational scroll are placed facing each other with their wraps being meshed, and the rotational scroll orbits relative to the fixed scroll to decrease the volume of a compression pocket formed between the two wraps while moving the compression pocket radially from outward to inward, thereby performing compression of refrigerant gas.

At actuation of the scroll compressor, reaction force due to the compressed refrigerant gas is applied to the end plate of the rotational scroll and the end plate of the fixed scroll. Thus, the rotational scroll is pressed in a direction in which the rotational scroll becomes separated from the fixed scroll in an axial direction, so that a gap called chip clearance is likely to be generated between a leading end surface (tooth top) of the wrap of each scroll and the other end plate. The refrigerant gas is leaked through the chip clearance, leading to degraded efficiency of the compressor.

For example, PTLs 1 and 2 each disclose a scroll compressor in which a back-pressure chamber is formed adjacent to a back side of the end plate of the rotational scroll with (or without) a thrust plate interposed therebetween, and part of the refrigerant gas compressed in the compression pocket is extracted and supplied to the back-pressure chamber so as to press the rotational scroll toward the fixed scroll so that the leading end surface of each wrap is constantly in contact with the other end plate.

When the back-pressure chamber adjacent to the back side of the end plate of the rotational scroll is formed to press the rotational scroll as described above, a view in an axial direction of a main shaft configured to rotationally drive the rotational scroll indicates that the back-pressure chamber is shaped in a ring around the main shaft. Such a ring-shaped back-pressure chamber has a larger area (width) with a smaller inner diameter and a larger outer diameter, thereby achieving enhanced pressing force on the rotational scroll.

CITATION LIST

Patent Literature

{PTL 1} Publication of Japanese Patent No. 3893487
{PTL 2} Japanese Unexamined Patent Application, Publication No. Hei8-159051

SUMMARY OF INVENTION

Technical Problem

As illustrated in FIG. 5, increasing the area (width) of a back-pressure chamber c adjacent to a back side of a rotational scroll a through a thrust plate b requires reduction in a diameter D1 of an O-ring inner seal ring d positioned radially inside of the back-pressure chamber c, and increase in a diameter D2 of an outer seal ring e positioned radially outside of the back-pressure chamber c, so as to increase an interval W1 between the inner seal ring d and the outer seal ring e.

However, the inner seal ring d and the outer seal ring e are each disposed through a seal ring groove formed on a thrust surface g of a housing f, which provides a limit on expansion of the interval W1 between the inner seal ring d and the outer seal ring e, thereby preventing effective increase in the area of the back-pressure chamber c.

The present invention is made in view of such circumstances and provide a scroll compressor in which the area of a back-pressure chamber can be increased so that pressing force on a rotational scroll due to back pressure is enhanced to reduce leakage of refrigerant gas through a chip clearance, thereby achieving improved compression efficiency.

The present invention is further intended to achieve reduction in activation torque and activation noise.

Solution to Problem

To solve the above-described problem, a scroll compressor according to the present invention employs the following solutions.

Specifically, a scroll compressor according to the present invention includes a scroll compression mechanism including a fixed scroll, a rotational scroll facing the fixed scroll to form a compression pocket for compressing refrigerant gas, a thrust plate configured to support a load of the rotational scroll in a thrust direction, and a main shaft configured to drive the rotational scroll, a back-pressure supplying mechanism configured to supply part of the refrigerant gas compressed through the scroll compression mechanism to a back side of the thrust plate as back pressure, and a housing that houses the scroll compression mechanism and the back-pressure supplying mechanism. The back-pressure supplying mechanism includes a back-pressure chamber formed on a thrust surface facing the back side of the thrust plate in the housing, a back-pressure supplying path through which the part of the compressed refrigerant gas is extracted and supplied to the back-pressure chamber, and an inner seal ring and an outer seal ring disposed radially inside and outside, respectively, of the back-pressure chamber to prevent leakage of the back pressure from the back-pressure chamber. The outer seal ring is provided to be pressed between an inner peripheral surface of the housing and an outer peripheral surface of the thrust plate.

In the scroll compressor with the above-described configuration, since the outer seal ring disposed radially outside of the back-pressure chamber is provided to be pressed between the inner peripheral surface of the housing and the outer peripheral surface of the thrust plate, a seal ring groove for the outer seal ring does not need to be formed on the thrust surface of the housing unlike the conventional technology. Thus, the back-pressure chamber can have a width increased radially outward without being affected by the seal ring groove. Accordingly, the back-pressure chamber can have an increased area so that pressing force on the rotational scroll due to the back pressure is enhanced to reduce leakage of the refrigerant gas, thereby achieving improved compression efficiency.

In the scroll compressor with the above-described configuration, the outer peripheral surface of the thrust plate may be tilted so that a ring space having a section shaped in a right triangle is formed by the inner peripheral surface of the housing, the thrust surface, and the outer peripheral surface of the thrust plate, and the outer seal ring may be pressed between three surfaces of the inner peripheral surface of the housing, the outer peripheral surface of the thrust plate, and the thrust surface.

With the above-described configuration, a triangle seal structure is formed that the outer seal ring is pressed between three surfaces of the inner peripheral surface of the housing, the outer peripheral surface of the thrust plate, and the thrust surface. Accordingly, the outer seal ring can be disposed in a radially outermost part of the thrust surface, thereby achieving increased width and area of the back-pressure chamber.

In the scroll compressor with the above-described configuration, the outer seal ring may be fitted into an outer peripheral groove formed on the outer peripheral surface of the thrust plate, and pressed between the outer peripheral groove and the inner peripheral surface of the housing.

With the above-described configuration, the outer seal ring is in contact only with the outer peripheral surface (outer peripheral groove) of the thrust plate and the inner peripheral surface of the housing, but is not in contact with the thrust surface, thereby achieving a maximized width and hence an increased area of the back-pressure chamber formed on the thrust surface.

In the scroll compressor with the above-described configuration, a chip clearance between the fixed scroll and the rotational scroll may be set to have a dimension that allows leakage of pressure from the compression pocket before the back pressure is supplied to the rotational scroll but does not allow leakage of pressure from the compression pocket after the back pressure is supplied to the rotational scroll.

With the above-described configuration, at activation of the scroll compressor, the chip clearance between the fixed scroll and the rotational scroll is large to have a large amount of leakage from the compression pocket, and thus needed activation torque is small. Then, after the activation of the scroll compressor, the pressure in the compression pocket gradually increases, and part of the pressure is supplied to the back surface of the thrust plate as the back pressure through the back-pressure supplying mechanism. This back pressure presses the rotational scroll to narrow the chip clearance, thereby reducing leakage from the compression pocket to achieve normal compression efficiency.

This prevents such a situation that, at activation, the rotational scroll receives the back pressure and abruptly moves toward and collides with the fixed scroll, thereby effectively preventing impact noise (activation noise) due to collision.

Advantageous Effects of Invention

As described above, in a scroll compressor according to the present invention, the area of a back-pressure chamber can be increased so that pressing force on a rotational scroll due to back pressure is enhanced to reduce leakage of refrigerant gas through a chip clearance, thereby achieving improved compression efficiency, and reduction in activation torque and noise at activation.

DESCRIPTION OF EMBODIMENTS

Embodiments of the present invention will be described below with reference to the accompanying drawings.

First Embodiment

Figure 1:
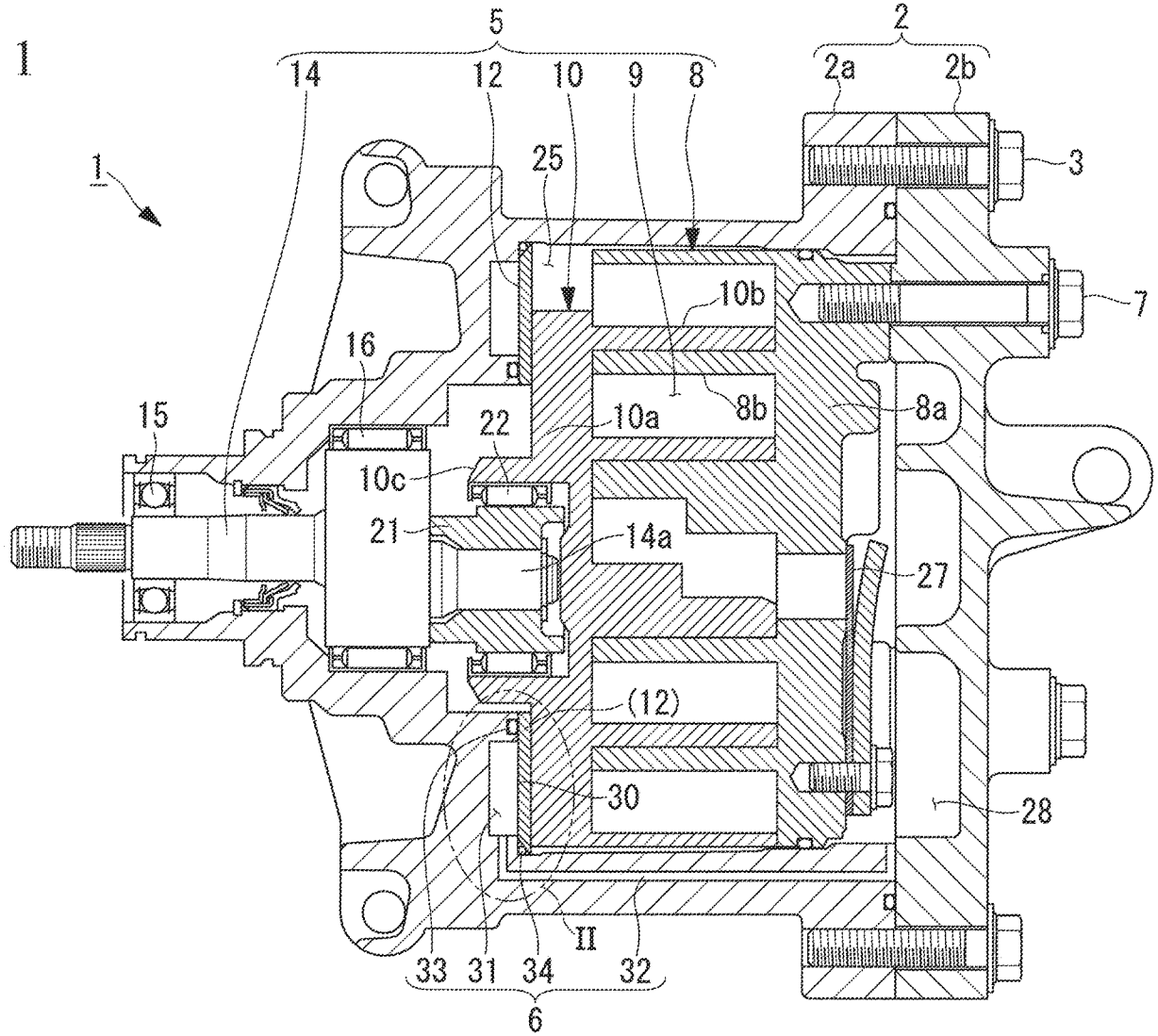
FIG. 1 is a longitudinal sectional view illustrating an exemplary scroll compressor according to the present invention.

FIG. 1 is a longitudinal sectional view illustrating an exemplary scroll compressor according to the present invention. This scroll compressor 1, incorporated in, for example, an air conditioning device of an automobile, and is driven by power of an engine (not illustrated) to compress refrigerant gas and supply the compressed refrigerant gas to a refrigerant circuit of the air conditioning device.

The scroll compressor 1 includes a housing 2 obtained by fastening a rear housing 2*b* to a front housing 2*a* through a bolt 3. The housing 2 houses a scroll compression mechanism 5 and a back-pressure supplying mechanism 6.

As well known, the scroll compression mechanism 5 includes a fixed scroll 8 fixed to the housing 2 (2*b*) through, for example, a bolt 7, a rotational scroll 10 facing the fixed scroll 8 to form a compression pocket 9 for compressing refrigerant gas, a thrust plate 12 configured to support a load of the rotational scroll 10 in a thrust direction, and a main shaft 14 configured to drive the rotational scroll 10. The main shaft 14 is pivotally supported by the front housing 2*a* through bearings 15 and 16, and has its leading end part externally protruding, to which a drive pulley (not illustrated) is attached.

The fixed scroll 8 and the rotational scroll 10 are provided with spiral wraps 8*b* and 10*b*, respectively, integrally formed on surfaces of circular end plates 8*a* and 10*a*. Leading end parts of the wraps 8*b* and 10*b* are in contact with the end plates 8*a* and 10*a* to which the wraps 8*b* and 10*b* face so as to smoothly slide relative to the end plates 8*a* and 10*a*, thereby forming a pair of the compression pockets 9 enclosed by the end plates 8*a* and 10*a* and the wraps 8*b* and 10*b*.

A decentering pin 14*a* provided to the main shaft 14 is engaged with an inner periphery of a boss 10*c* of the rotational scroll 10 through a bush 21 and a bearing 22. When the main shaft 14 rotates, the rotational scroll 10 rotates while being prevented from spinning by a spin preventing mechanism (not illustrated). With this configuration, the volumes of the pair of the compression pockets 9 formed between the wraps 8*b* and 10*b* of the fixed scroll 8 and the rotational scroll 10 decrease as the compression pockets 9 moves radially from outward to inward. Accordingly, refrigerant gas taken in through an intake port (not illustrated) provided to a low-pressure chamber 25 in the front housing 2*a* is taken into and compressed in the compression pockets 9. Then, the refrigerant gas compressed at high pressure is ejected through a discharge port (not illustrated) provided to the rear housing 2*b* through a discharge valve 27 and a high-pressure chamber 28.

During the compression of the refrigerant gas, reaction force due to the compressed refrigerant gas is applied to the end plate 8*a* of the fixed scroll 8 and the end plate 10*a* of the rotational scroll 10, thereby pressing the rotational scroll 10 movable relative to the fixed scroll 8 in a direction (the thrust direction) in which the rotational scroll 10 becomes separated from the fixed scroll 8 in an axial direction. This thrust load of the rotational scroll 10 is supported by the thrust plate 12, and in addition, transferred to a thrust surface 30 formed in the front housing 2*a* and facing a back side of the thrust plate 12.

Figure 2A:
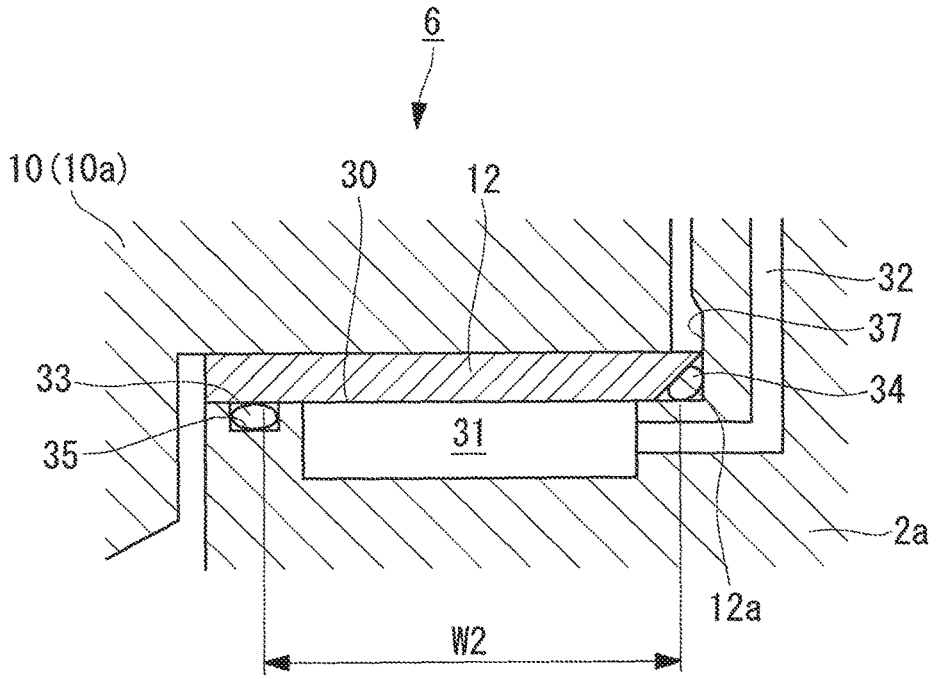
FIG. 2 is a longitudinal sectional view of a back-pressure supplying mechanism according to a first embodiment of the present invention, illustrating Part II in FIG. 1 in an enlarged manner, in which (a) illustrates a case in which back pressure is not acting, and (b) illustrates a case in which back pressure is acting.
Figure 2B:
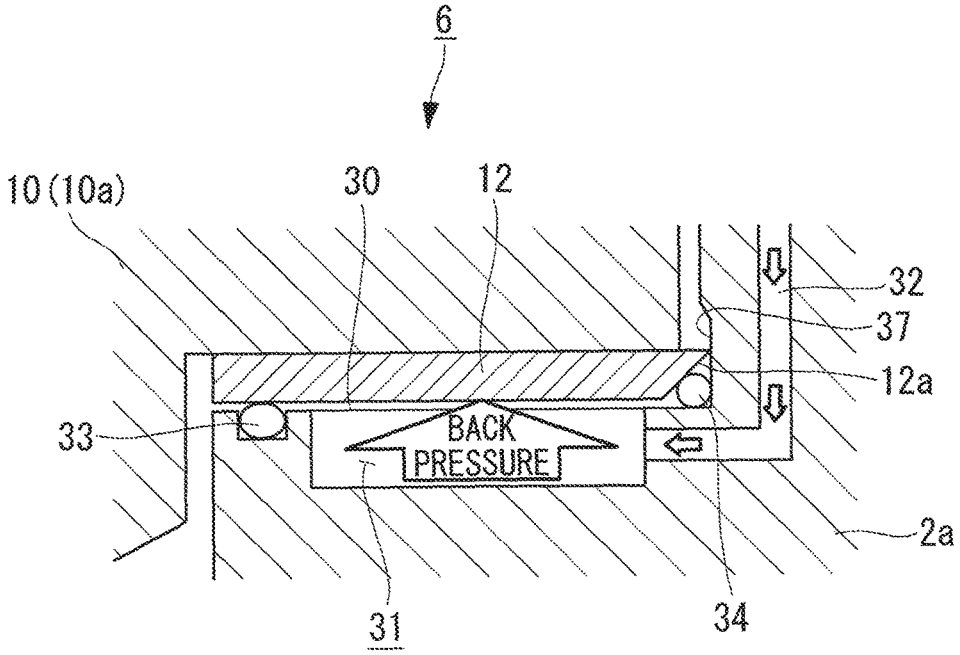

The back-pressure supplying mechanism 6 is configured to supply part of the refrigerant gas compressed through the scroll compression mechanism 5 to the back side of the thrust plate 12 as back pressure. As illustrated in FIG. 2, the back-pressure supplying mechanism 6 includes a ring-shaped back-pressure chamber 31 formed on the thrust surface 30, a back-pressure supplying path 32 formed inside of the front housing 2*a* and communicating the high-pressure chamber 28 and the back-pressure chamber 31 with each other, and an inner seal ring 33 and an outer seal ring 34 disposed radially inside and outside, respectively, of the back-pressure chamber 31.

The back-pressure supplying path 32 is a path through which the part of the refrigerant gas compressed in each compression pocket 9 and ejected to the high-pressure chamber 28 is extracted and supplied to the back-pressure chamber 31. The inner seal ring 33 and the outer seal ring 34 prevent leakage of the back pressure from the back-pressure chamber 31, maintaining air-tightness. The inner seal ring 33 and the outer seal ring 34 are O-rings formed of elastic material such as rubber, and having circular sectional shapes in a non-compression state, but may have any sectional shape other than a circular shape.

FIGS. 2(*a*) and 2(*b*) are longitudinal sectional views of the back-pressure supplying mechanism 6 according to a first embodiment of the present invention, illustrating Part II in FIG. 1 in an enlarged manner. The thrust plate 12 is interposed between the thrust surface 30 of the front housing 2*a* and the rotational scroll 10 (end plate 10*a*) so as to close off the back-pressure chamber 31.

Similarly to the conventional structure (refer to FIG. 5), the inner seal ring 33 is formed on the thrust surface 30 and fitted to a seal ring groove 35 positioned radially inside of the back-pressure chamber 31. An outer peripheral surface 12*a* of the thrust plate 12 is obliquely tilted at approximately 45 degrees, and forms, together with the thrust surface 30 and an inner peripheral surface 37 of the front housing 2*a*, a ring space having a section shaped in an isosceles right triangle. The outer seal ring 34 is mounted inside of this ring space. With this configuration, the seal ring 34 is pressed between three surfaces of the slanted outer peripheral surface 12*a* of the thrust plate 12, the thrust surface 30, and the inner peripheral surface 37.

The following describes actions and effects of the scroll compressor 1 configured as described above.

At activation of the scroll compressor 1, the refrigerant gas is compressed in each compression pocket 9, but the pressure of the compression is still low, so that the end plate 10*a* of the rotational scroll 10 is pressed toward the thrust plate 12 by the compression pressure as illustrated in FIG. 2(*a*). At this stage, pressure inside of the high-pressure chamber 28 is low, and thus no back pressure is supplied to the back-pressure chamber 31.

After the activation of the scroll compressor 1, upon increase of pressure in the compression pocket 9 and the high-pressure chamber 28, part of the compressed refrigerant gas in the high-pressure chamber 28 is extracted though the back-pressure supplying path 32 and supplied to the back-pressure chamber 31. Accordingly, as illustrated in FIG. 2(*b*), back pressure acts on the thrust plate 12 and presses to float the thrust plate 12 and the rotational scroll 10 (end plate 10*a*) above the thrust surface 30. With this configuration, the leading end parts of the wraps 10*b* and 8*b* of the rotational scroll 10 and the fixed scroll 8 illustrated in FIG. 1 can be reliably made contact with the corresponding end plates 8*b* and 10*b* to prevent generation of a chip clearance (gap) and leakage of the refrigerant gas, thereby achieving improved efficiency of the scroll compressor 1.

In the present embodiment, the outer seal ring 34 disposed radially outside of the back-pressure chamber 31 is provided to be pressed between the inner peripheral surface 37 of the front housing 2*a* and the outer peripheral surface 12*a* of the thrust plate 12. This configuration eliminates the need to form, on the thrust surface 30, a seal ring groove (groove for outer seal ring e illustrated in FIG. 5) for engagement with the outer seal ring 34, which has been conventionally done.

Figure 5:
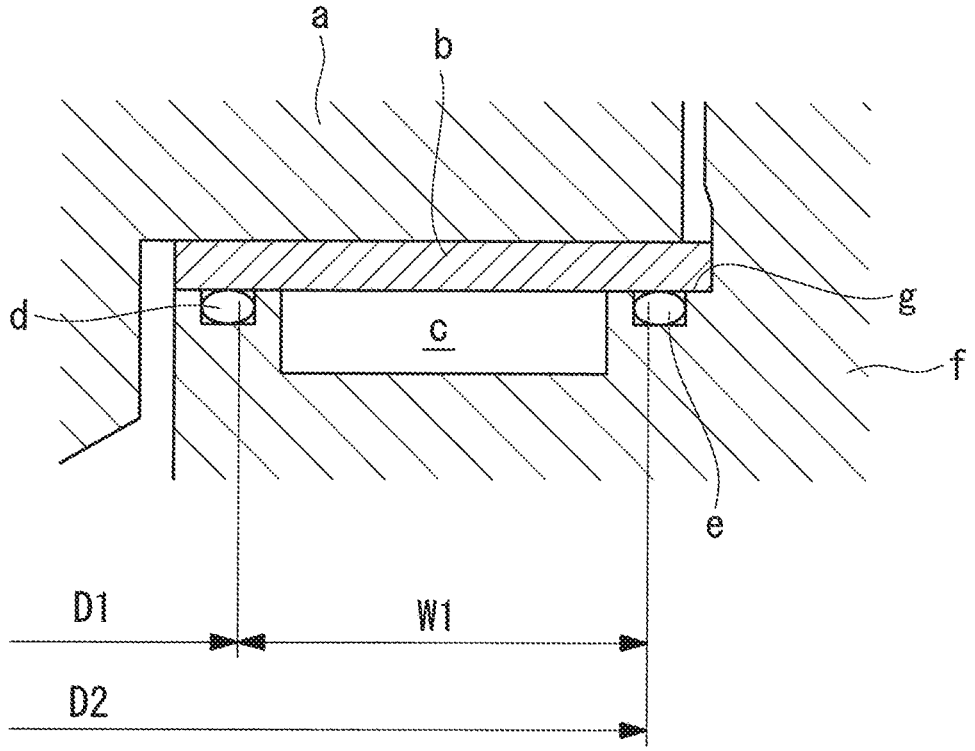
FIG. 5 is a longitudinal sectional view of the vicinity of a back-pressure chamber, indicating a problem with the conventional technology.

Accordingly, an interval (width) W2 between the inner seal ring 33 and the outer seal ring 34 can be set to be larger than a conventional width (interval) W1 illustrated in FIG. 5, and thus the width of the back-pressure chamber 31 formed therebetween can be increased. The back pressure applied to the back-pressure chamber 31 having an increased width acts on the thrust plate 12 across the entire width W2 between the inner seal ring 33 and the outer seal ring 34. Accordingly, pressing force on the rotational scroll 10 by the back pressure can be increased to reduce leakage of the refrigerant gas, thereby achieving improved compression efficiency of the scroll compressor 1.

In addition, the outer peripheral surface 12*a* of the thrust plate 12 is tilted so that the ring space having a section shaped in an isosceles right triangle is formed by the outer peripheral surface 12*a*, the inner peripheral surface 37 of the front housing 2*a*, and the thrust surface 30, and such a triangular seal structure in which the outer seal ring 34 is pressed between these three surfaces 12*a*, 37, and 30 is formed. With this configuration, the outer seal ring 34 can be disposed in a radially outermost part of the thrust surface 30, which results in increase in the width W2 and the area of the back-pressure chamber 31.

Second Embodiment

Figure 3A:
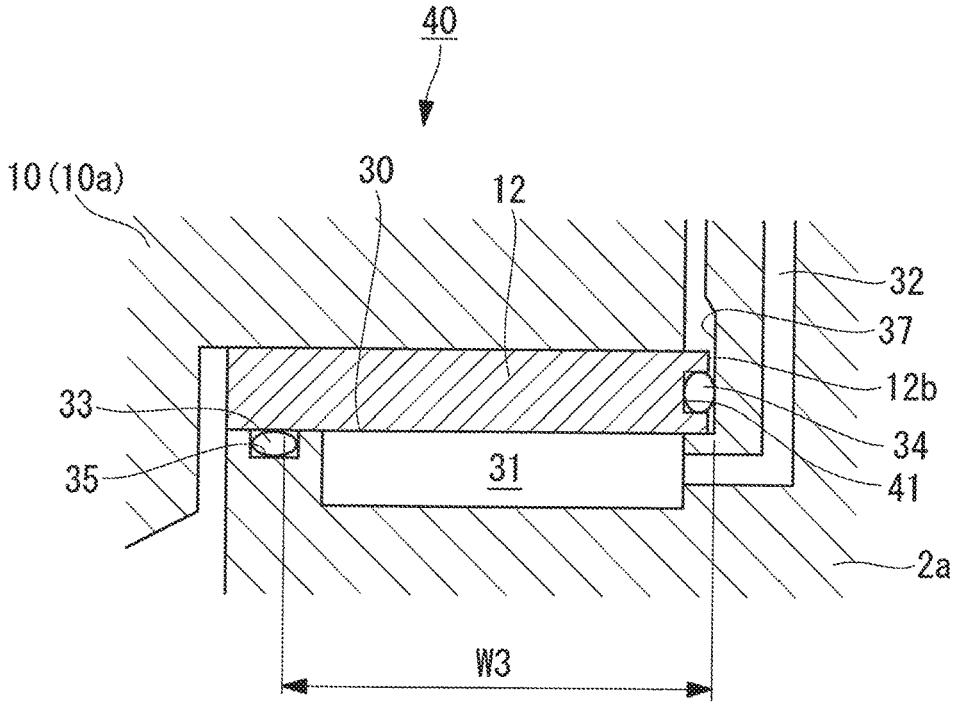
FIG. 3 is a longitudinal sectional view of a back-pressure supplying mechanism according to a second embodiment of the present invention, in which (a) illustrates a case in which back pressure is not acting, and (b) illustrates a case in which back pressure is acting.
Figure 3B:
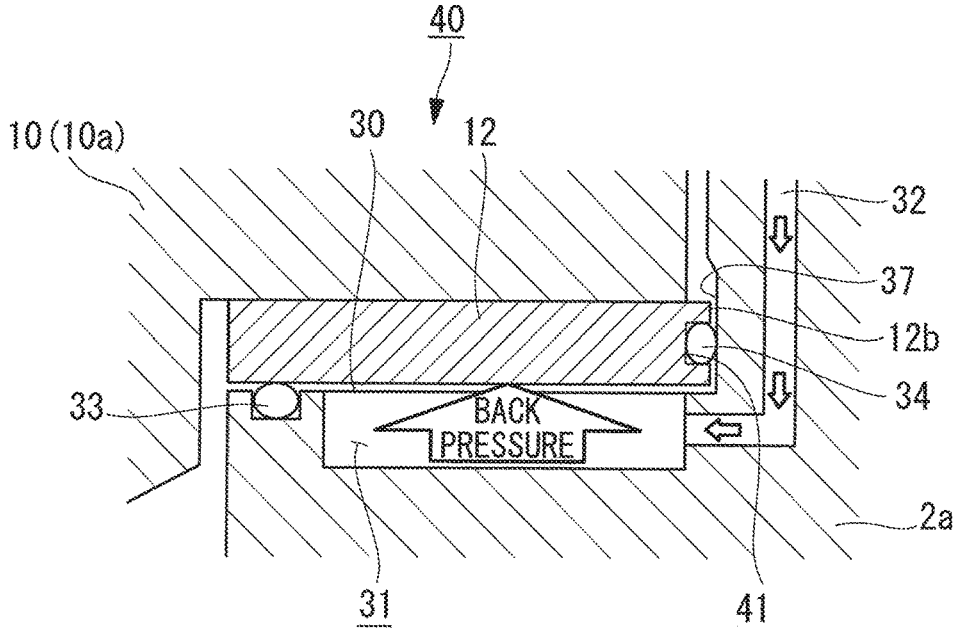

FIGS. 3(*a*) and 3(*b*) are longitudinal sectional views of a back-pressure supplying mechanism 40 according to a second embodiment of the present invention. The back-pressure supplying mechanism 40 has a configuration same as that of the back-pressure supplying mechanism 6 according to the first embodiment except for disposition of the outer seal ring 34 maintaining the air-tightness of the back-pressure chamber 31. Any identical component is denoted by an identical reference sign, and description thereof will be omitted.

In the back-pressure supplying mechanism 40, an outer peripheral surface 12*b* of the thrust plate 12 is a cylindrical surface parallel to the inner peripheral surface 37 of the front housing 2*a*. The outer seal ring 34 is fitted into an outer peripheral groove 41 formed on the outer peripheral surface 12*b* of the thrust plate 12 and is mounted being pressed between the outer peripheral groove 41 and the inner peripheral surface 37 of the front housing 2*a*. Thus, the outer seal ring 34 is not in contact with the thrust plate 12.

In the back-pressure supplying mechanism 40 having the above-described configuration, the outer seal ring 34 is in contact only with the outer peripheral surface 12*b* of the thrust plate 12 (outer peripheral groove 41) and the inner peripheral surface 37 of the front housing 2*a*, but is not in contact with the thrust surface 30. With this configuration, an interval (width) W3 between the inner seal ring 33 and an outer peripheral part (i.e., the inner peripheral surface 37) of the outer seal ring 34 is larger than the interval W2 in the first embodiment (refer to FIG. 2), and thus the width of the back-pressure chamber 31 formed therebetween can be larger than that in the first embodiment. The back pressure applied to the back-pressure chamber 31 having an increased width acts on the thrust plate 12 across the entire interval W3 between the inner seal ring 33 and the outer peripheral part (inner peripheral surface 37) of the outer seal ring 34. Accordingly, pressing force on the rotational scroll 10 by the back pressure can be further increased to reduce leakage of the refrigerant gas, thereby achieving improved compression efficiency of the scroll compressor 1.

When the back pressure is applied on the back-pressure chamber 31 to float the thrust plate 12 at activation of the scroll compressor 1, the outer seal ring 34 slides relative to the inner peripheral surface 37 of the front housing 2*a*, or deforms, and thus braking force due to slide resistance or deformation resistance is applied to motion of the thrust plate 12. This can prevent generation of abnormal noise (activation noise) due to collision of the rotational scroll 10 with the fixed scroll 8 caused when the thrust plate 12 abruptly floats.

Third Embodiment

Figure 4A:
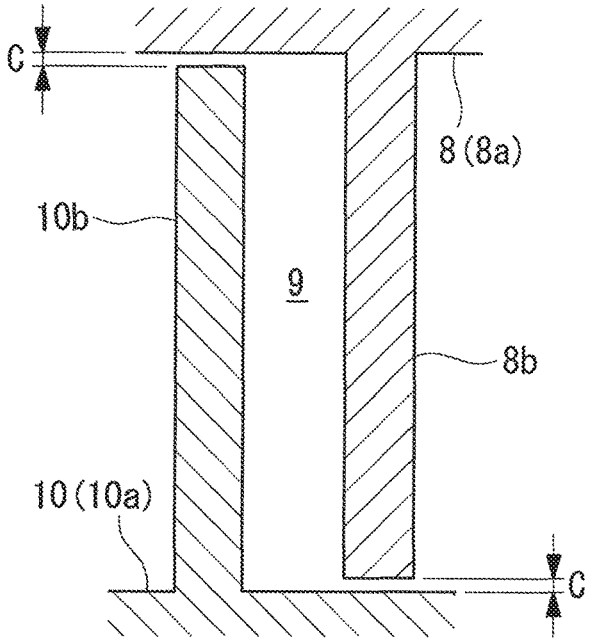
FIG. 4 is a longitudinal sectional view partially illustrating a rotational scroll and a fixed scroll according to a third embodiment of the present invention, in which (a) illustrates a case in which back pressure is not acting, and (b) illustrates a case in which back pressure is acting.
Figure 4B:
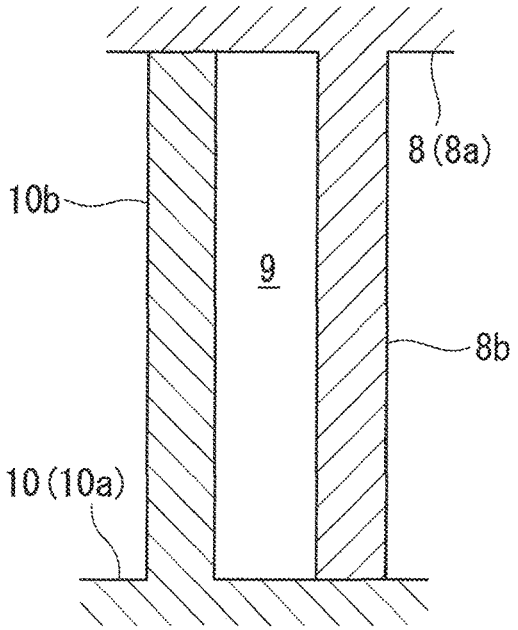

FIGS. 4(*a*) and 4(*b*) are longitudinal sectional views partially illustrating the rotational scroll and the fixed scroll according to a third embodiment of the present invention. The present embodiment is preferably performed in combination with the configurations in the first embodiment and the second embodiment.

In the third embodiment, as illustrated in FIG. 4(*a*), before the back pressure is supplied to the rotational scroll 10, a predetermined chip clearance C is provided between the leading end part of the wrap 8*b* of the fixed scroll 8 and the end plate 10*a* of the rotational scroll 10, and between the leading end part of the wrap 10*b* of the rotational scroll 10 and the end plate 8*a* of the fixed scroll 8.

The dimension of the chip clearance C is set to approximately 0.6 mm to 0.8 mm to allow leakage of pressure from the compression pocket 9.

As illustrated in FIG. 4(*b*), after the back pressure is supplied to the rotational scroll 10, the chip clearance C disappears due to floating of the rotational scroll 10 by the back pressure, thereby preventing leakage of pressure from the compression pocket 9.

The well-known chip seal may be provided to the leading end part of the wrap 8*b* of the fixed scroll 8 and the leading end part of the wrap 10*b* of the rotational scroll 10. With this configuration, the compression leakage can be more reliably prevented.

According to the present configuration, at activation of the scroll compressor 1, the chip clearance C between the fixed scroll 8 and the rotational scroll 10 is large enough to have a large amount of leakage from the compression pocket 9, and thus needed activation torque is small.

Then, after the activation of the scroll compressor 1, the pressure in the compression pocket 9 gradually increases, and part of the pressure is supplied as back pressure to a back surface (the back-pressure chamber 31) of the thrust plate 12 through the back-pressure supplying mechanisms 6 and 40 illustrated in FIGS. 2 and 3. This back pressure presses the rotational scroll 10 to narrow the chip clearance C, thereby reducing leakage from the compression pocket 9 to achieve normal compression efficiency.

This prevents such a situation that, at activation, the rotational scroll 10 receives the back pressure and abruptly moves toward and collides with the fixed scroll 8, thereby effectively preventing impact noise (activation noise) due to collision.

As described above, in the scroll compressor 1 according to the present embodiment, the area of the back-pressure chamber 31 can be increased so that pressing force on the rotational scroll 10 due to the back pressure is enhanced to reduce leakage of the refrigerant gas through the chip clearance, thereby achieving improved compression efficiency, and reduction in activation torque and noise at activation.

The present invention is not limited only to the configurations in the above-described embodiments, but any change or modification may be added as appropriate without departing from the gist of the present invention, and any embodiment including such change or modification is included in the scope of rights in the present invention.

For example, the scroll compressor 1 described in the above embodiments is used in an air conditioning device of an automobile but is not limited thereto. The present invention is applicable to a scroll compressor used in an air conditioning device of a structure such as a house, a building or a warehouse.

The scroll compressor 1 in the above-described embodiments is driven by an external power such as an engine of an automobile, but the present invention is applicable to an electric scroll compressor integrally provided with an electric motor.

REFERENCE SIGNS LIST

1 scroll compressor
2 housing
5 scroll compression mechanism
6 back-pressure supplying mechanism
8 fixed scroll
9 compression pocket
10 rotational scroll
12 thrust plate
12*a*, 12*b* outer peripheral surface of thrust plate
14 main shaft
25 low-pressure chamber
28 high-pressure chamber
30 thrust surface
31 back-pressure chamber
32 back-pressure supplying path
33 inner seal ring
34 outer seal ring
37 inner peripheral surface of housing
41 outer peripheral groove
C chip clearance

The invention claimed is:

1. A scroll compressor comprising:

a scroll compression mechanism including a fixed scroll, a rotational scroll facing the fixed scroll to form a compression pocket for compressing refrigerant gas, a thrust plate configured to support a load of the rotational scroll in a thrust direction, and a main shaft configured to drive the rotational scroll;

a back-pressure supplying mechanism configured to supply part of the refrigerant gas compressed through the scroll compression mechanism to a back side of the thrust plate as back pressure; and a housing that houses the scroll compression mechanism and the back-pressure supplying mechanism, wherein:

the back-pressure supplying mechanism includes a back-pressure chamber formed on a thrust surface facing the back side of the thrust plate in the housing, a back-pressure supplying path through which the part of the compressed refrigerant gas is extracted and supplied to the back-pressure chamber, and an inner seal ring and an outer seal ring disposed radially inside and outside, respectively, of the back-pressure chamber to prevent leakage of the back pressure from the back-pressure chamber, the inner seal ring is provided in a space formed radially inside of the back-pressure chamber so that the inner seal ring is pressed between the thrust plate and the thrust surface, the outer seal ring is provided in a space formed radially outside of the back-pressure chamber so that the outer seal ring is pressed between an inner peripheral surface of the housing and an outer peripheral surface of the thrust plate, and the back-pressure supplying path communicates a high pressure chamber to which the refrigerant gas is ejected from the compression pocket and an outer peripheral side surface of the back-pressure chamber.

2. The scroll compressor according to claim 1, wherein the outer seal ring is fitted into an outer peripheral groove formed on the outer peripheral surface of the thrust plate and is pressed between the outer peripheral groove and the inner peripheral surface of the housing.

3. A scroll compressor comprising:

a scroll compression mechanism including a fixed scroll, a rotational scroll facing the fixed scroll to form a compression pocket for compressing refrigerant gas, a thrust plate configured to support a load of the rotational scroll in a thrust direction, and a main shaft configured to drive the rotational scroll;

a back-pressure supplying mechanism configured to supply part of the refrigerant gas compressed through the scroll compression mechanism to a back side of the thrust plate as back pressure; and a housing that houses the scroll compression mechanism and the back-pressure supplying mechanism, wherein:

the back-pressure supplying mechanism includes a back-pressure chamber formed on a thrust surface facing the back side of the thrust plate in the housing, a back-pressure supplying path through which a part of the compressed refrigerant gas is extracted and supplied to the back-pressure chamber, and an inner seal ring and an outer seal ring disposed radially inside and outside, respectively, of the back-pressure chamber to prevent leakage of the back pressure from the back-pressure chamber, an outer peripheral surface of the thrust plate is tilted so that a ring space having a section shaped in a right triangle is formed radially outside of the back-pressure chamber by an inner peripheral surface of the housing, the thrust surface, and the outer peripheral surface of the thrust plate, and the outer seal ring is pressed between three surfaces of the inner peripheral surface of the housing, the outer peripheral surface of the thrust plate, and the thrust surface.

4. The scroll compressor according to claim 3, wherein a chip clearance between the fixed scroll and the rotational scroll is set to have a dimension that allows leakage of pressure from the compression pocket before the back pressure is supplied to the rotational scroll but does not allow leakage of pressure from the compression pocket after the back pressure is supplied to the rotational scroll.

* * * * *